US006666128B2

(12) United States Patent
Sugiura et al.

(10) Patent No.: US 6,666,128 B2
(45) Date of Patent: Dec. 23, 2003

(54) SWASH PLATE IN SWASH PLATE TYPE COMPRESSOR

(75) Inventors: Manabu Sugiura, Kariya (JP); Takayuki Kato, Kariya (JP); Hideki Mizutani, Kariya (JP); Takahiro Sugioka, Kariya (JP); Akira Onoda, Kariya (JP); Tomohiro Murakami, Kariya (JP); Shino Okubo, Kariya (JP)

(73) Assignee: Kabushiki Kaisha Toyoto Jidoshokki, Kariya (JP)

( * ) Notice: Subject to any disclaimer, the term of this patent is extended or adjusted under 35 U.S.C. 154(b) by 0 days.

(21) Appl. No.: 10/126,037

(22) Filed: Apr. 18, 2002

(65) Prior Publication Data

US 2002/0159893 A1 Oct. 31, 2002

(30) Foreign Application Priority Data

Apr. 20, 2001 (JP) ..... 2001-123038

(51) Int. Cl.[7] ..... F04B 27/08

(52) U.S. Cl. ..... 92/71; 92/155

(58) Field of Search ..... 92/71, 153, 155

(56) References Cited

U.S. PATENT DOCUMENTS

| | | | | | |
|---|---|---|---|---|---|
| 5,813,315 | A | * | 9/1998 | Kristensen et al. | 92/71 |
| 5,974,946 | A | | 11/1999 | Kanou et al. | 92/71 |
| 6,123,009 | A | * | 9/2000 | Kanayama et al. | 92/71 |
| 6,129,996 | A | * | 10/2000 | Cordy | 428/646 |
| 6,192,784 | B1 | * | 2/2001 | Kato et al. | 92/71 |

* cited by examiner

*Primary Examiner*—Edward K. Look
*Assistant Examiner*—Thomas E. Lazo
(74) *Attorney, Agent, or Firm*—Morgan & Finnegan, LLP

(57) ABSTRACT

A swash plate type variable displacement compressor has a housing, a drive shaft, a swash plate and a piston. The housing includes a cylinder block, a front housing, and a rear housing. The drive shaft is rotatably supported by the housing. The swash plate is connected to the drive shaft, and is integrally rotatable with the drive shaft and tiltable relative to the drive shaft. The piston engages with the swash plate through a pair of shoes. Rotation of the drive shaft is converted to reciprocation of the piston through the swash plate and the shoes, and the displacement of the compressor is adjusted by varying the inclination angle of the swash plate with respect to the axis of the drive shaft. The swash plate includes a base member made of copper series and a sliding layer coating a sliding surface of the base member with respect to the shoes.

22 Claims, 2 Drawing Sheets

SWASH PLATE IN SWASH PLATE TYPE COMPRESSOR

BACKGROUND OF THE INVENTION

The present invention relates to a compressor and more particularly to a swash plate in a swash plate type variable displacement compressor for an air conditioner of a vehicle.

A swash plate type variable displacement compressor generally has a swash plate, which is operatively connected to a drive shaft. The swash plate is integrally rotatable with a drive shaft and tiltable with respect to the axis of the drive shaft. A single-headed piston engages with the swash plate through a pair of shoes. The rotation of the drive shaft is converted to the reciprocation of the piston through the swash plate and the shoes. The displacement of the compressor is adjusted by varying the inclination angle of the swash plate with respect to the axis of the drive shaft.

The swash plate is generally made of iron series. If the weight of the swash plate is relatively light, the moment of inertia due to the rotation, which influences the adjustment of the inclination angle of the swash plate, does not appropriately work. Accordingly, especially when the drive shaft rotates at high speed, or when the compressor operates at high speed, controllability of the displacement of the compressor may deteriorate. Therefore, since copper series is heavier in the same shape than iron series, the swash plate made of copper series is also applied.

Since the shoes slide on the swash plate, sliding surfaces between the shoes and the swash plate may abrade. Both ensuring controllable displacement of the compressor and relatively high sliding performance of the swash plate with respect to the shoes upon operating at high speed are achieved by utilizing copper series material containing lead as solid lubricant for forming base member of the swash plate. However, utilizing much lead, which is a toxic substance, is undesirable.

SUMMARY OF THE INVENTION

The present invention addresses the above-mentioned problems traceable to a material containing relatively much lead by adopting another structure without containing relatively much lead.

According to the present invention, a swash plate type variable displacement compressor has a housing, a drive shaft, a swash plate and a piston. The housing is formed by a cylinder block, a front housing, and a rear housing. The drive shaft is rotatably supported by the housing. The swash plate is connected to the drive shaft, and is integrally rotatable with the drive shaft and tiltable relative to the drive shaft. The piston engages with the swash plate through a pair of shoes. Rotation of the drive shaft is converted to reciprocation of the piston through the swash plate and the shoe, and the displacement of the compressor is adjusted by varying the inclination angle of the swash plate with respect to the axis of the drive shaft. The swash plate includes a base member made of copper series and a sliding layer coating a sliding surface of the base metal relative to the shoe.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

An embodiment of the present invention will now be described with reference to FIGS. 1 to 2C. The left side and the right side correspond to the front side and the rear side in FIGS. 1 to 2C, respectively.

Figure 1:
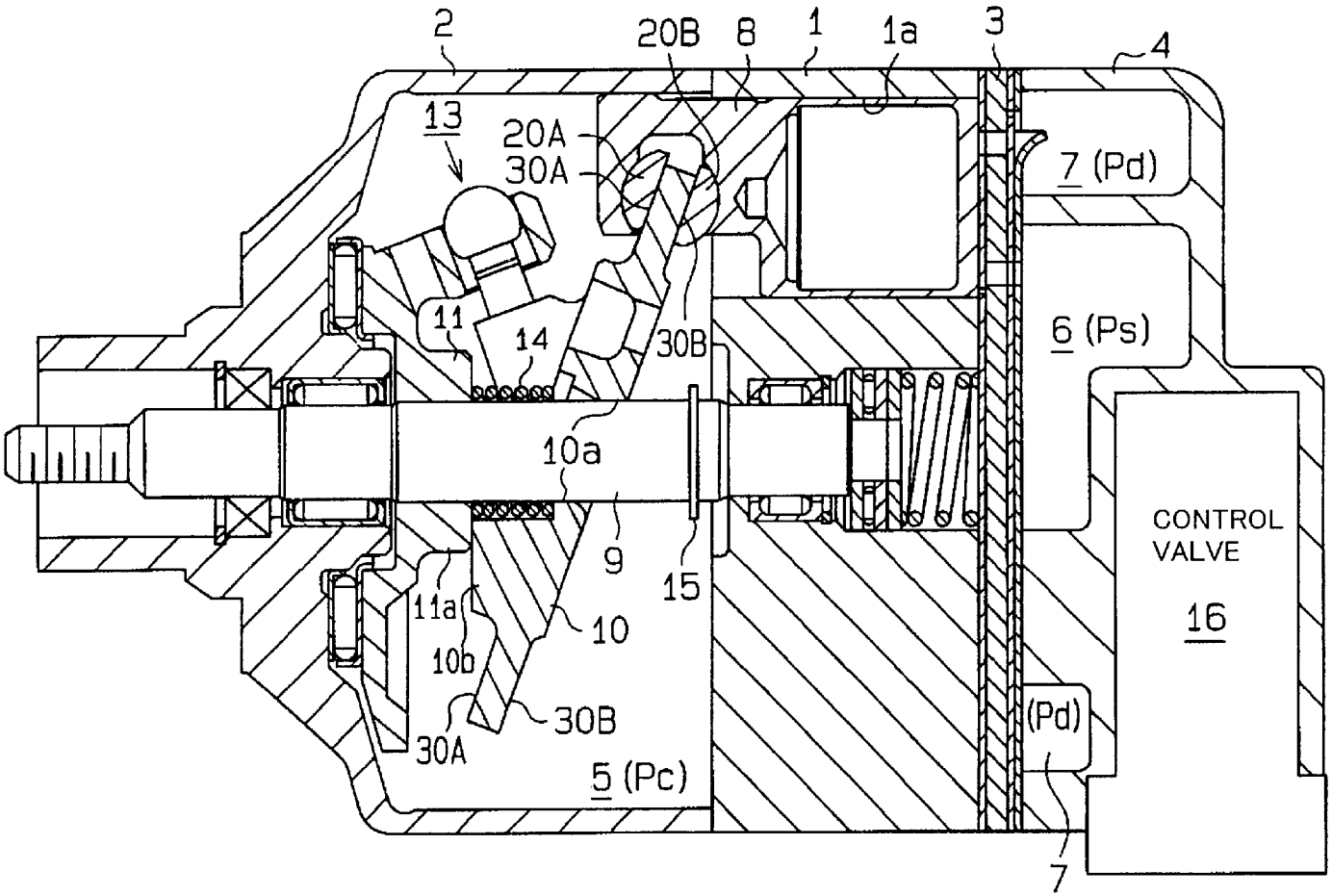
FIG. 1 is a longitudinal cross-sectional view of a swash plate type variable displacement compressor according to an embodiment of the present invention.

As shown in FIG. 1, a swash plate type variable displacement compressor has a cylinder block 1, a front housing 2 and a rear housing 4. The front housing 2 connects with the front end of the cylinder block 1. The rear housing 4 connects with the rear end of the cylinder block 1 through a valve plate assembly 3. The cylinder block 1, the front housing 2, the rear housing 4 and the valve plate assembly 3 are screw-on together by a plurality of bolts, which are not shown, and constitute a housing of the compressor.

A crank chamber 5, a suction chamber 6 and a discharge chamber 7 are defined in the housing. A plurality of cylinder bores la (only one is shown) is defined in the cylinder block 1, and the cylinder bores 1*a* each accommodate a single-headed piston 8 so as to reciprocate. The pistons 8 are made of aluminum series to reduce their weight. The suction chamber 6 and the discharge chamber 7 selectively communicate with the cylinder bores 1*a* through respective flapper valves, which are formed with the valve plate assembly 3.

A drive shaft 9 extending through the crank chamber 5 is rotatably supported by the housing. A swash plate 10 as a cam plate is accommodated in the crank chamber 5. A through hole 10*a* is formed through the center of the swash plate 10, and the drive shaft 9 extends through the through hole 10*a*. The swash plate 10 operatively connects with the drive shaft 9 through a hinge mechanism 13 and a lug plate 11. The swash plate 10 synchronously rotates with the drive shaft 9, and tilts with respect to a plane perpendicular to the axis of the drive shaft 9 as slides in an axial direction of the drive shaft 9.

The pistons 8 all are operatively connected to the swash plate 10 by slidably engaging the pistons 8 with the periphery of the swash plate 10 through a pair of shoes 20A, 20B. Besides, since the shoes 20A, 20B need certain physical strength and slide with respect to the pistons 8 made of aluminum series, the shoes 20A, 20B are made of iron series such as bearing steel.

As the swash plate 10 tilted to a predetermined angle rotates integrally with the drive shaft 9, the pistons 8 each reciprocate at a stroke corresponding to the inclination angle of the swash plate 10 relative to a plane perpendicular to the axis of the drive shaft 9. Thereby, in the associated cylinder bores 1*a*, refrigerant gas sucked from the suction chamber 6 in a suction pressure Ps region is compressed, and the compressed refrigerant gas is discharged to the discharge chamber 7 in a discharge pressure Pd region, thus repeating the operation.

The swash plate 10 is urged in a direction to approach the cylinder block 1 by a coil spring 14, that is, in a direction to reduce the inclination angle of the swash plate 10. However, for example, the inclination angle of the swash plate 10 is regulated by a circular clip 15, which engages with the drive shaft 9, thereby limiting the minimum inclination angle θ min of the swash plate 10. Meanwhile, for example, a counter weight 10*b* of the swash plate 10 abuts against a retaining portion 11*a* of the lug plate 11, thereby limiting the maximum inclination angle θ max of the swash plate 10.

The inclination angle of the swash plate 10 is determined based on resultant moment among moment of rotational motion based on centrifugal force generated upon rotation of the swash plate 10, moment of urging force of the spring 14, moment of inertial force of reciprocation of the piston 8 and moment based on gas pressure.

The above-mentioned moment based on the gas pressure is moment generated based on resultant force due to pressure between pressures in the cylinder bores la and pressure in the crank chamber 5 or crank pressure Pc applying to the pistons 8, and the moment acts not only in a direction to reduce the inclination angle but also in a direction to increase the inclination angle in response to the crank pressure Pc. In the swash plate type compressor shown in FIG. 1, the moment based on the gas pressure is varied by adjusting the crank pressure Pc by means of a control valve 16, which is not described. Thereby, the inclination angle of the swash plate 20 is set for a certain angle, which ranges from the minimum inclination angle θ min to the maximum inclination angle θ max.

Figure 2A:
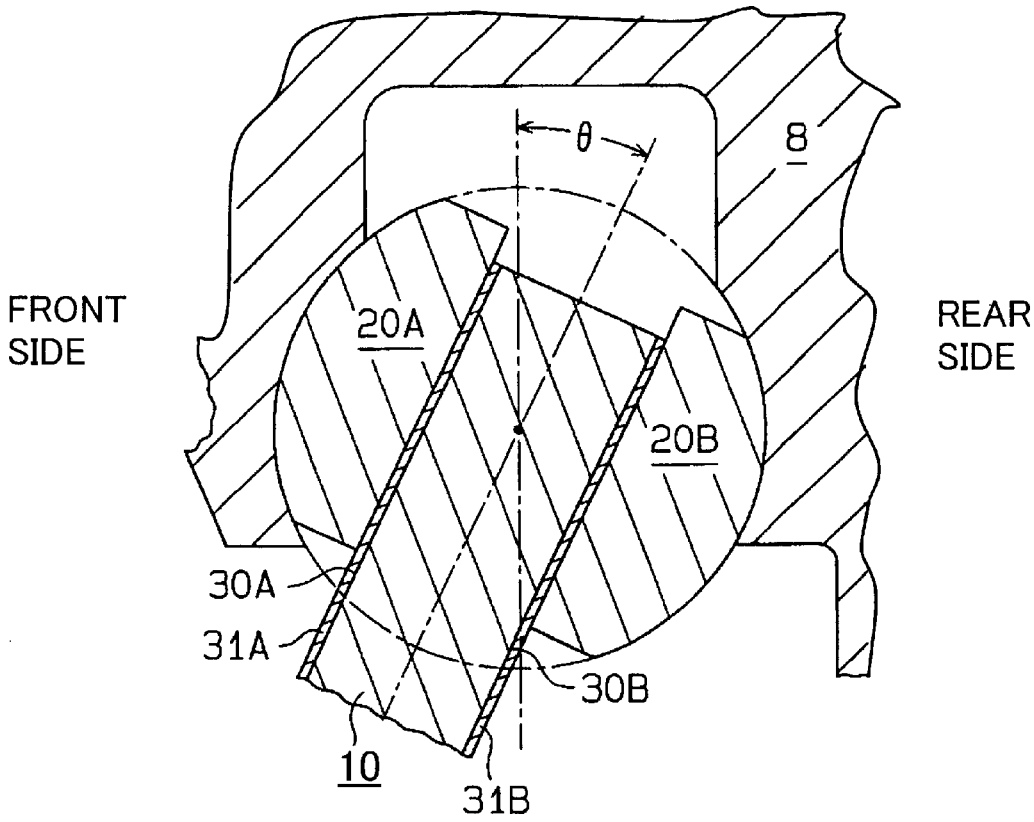
FIG. 2A is an enlarged partial cross-sectional view of a pair of shoes, a swash plate, a piston and sliding layers in FIG. 1.
Figure 2B:
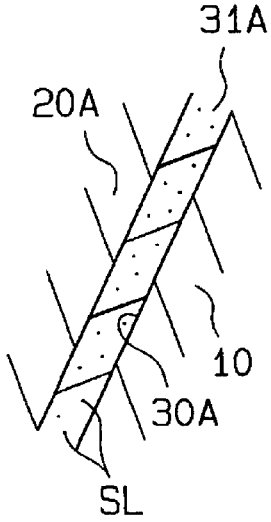
FIG. 2B is an enlarged partial cross-sectional view of a sliding layer between a shoe and a swash plate in FIG. 2A.
Figure 2C:
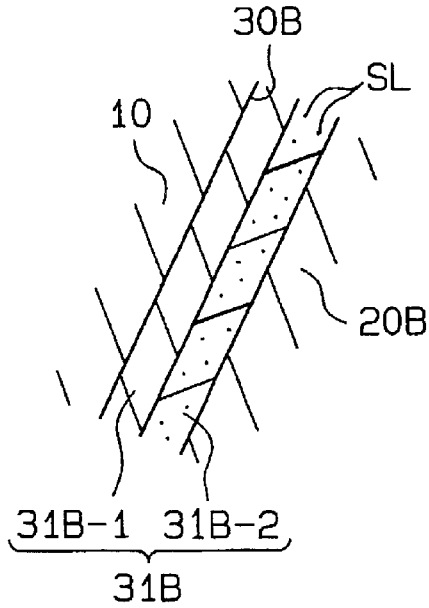
FIG. 2C is an enlarged partial cross-sectional view of another sliding layer between a shoe and a swash plate in FIG. 2A.

As shown in FIGS. 1 to 2C, the front surface and rear surface of the outer periphery of the swash plate 10, which are engaged with the pistons 8, provide sliding surfaces 30A, 30B, respectively. The front and rear annular sliding surfaces 30A, 30B slide with respect to a pair of the shoes 20A, 20B, respectively.

To effectively generate the moment of rotational motion based on centrifugal force upon rotation of the swash plate 10, for example, the base member of the swash plate 10 is made of copper series, which is heavier than iron series. Bronze alloy without lead or a solid metal of high tensile brass alloy are used as a material of the copper series, and the swash plate 10 is shaped by molding, or by machining a solid metal blank. The weight of the swash plate 10 becomes heavier by making the base member of the swash plate 10 out of the solid metal, for example, as compared with that of the swash plate 10 made of a sintered metal of copper series, which will be described later in another embodiment. Namely, the sintered material includes relatively many microscopic gaps. Therefore, the weight of the sintered metal tends to be lighter than the solid metal.

As shown in FIG. 2A, at least the sliding surfaces 30A, 30B of the swash plate 10 are coated with sliding layers 31A, 31B for improving sliding performance with respect to the shoes 20A, 20B.

As shown in FIG. 2B, the sliding layer 31A out of the sliding layers 31A, 31B, that is, the layer formed on the front sliding surface 30A is made of synthetic resin, and dispersedly contains solid lubricant SL. The thickness of the sliding layer 31A ranges from 0.5 μm to 10 μm. The solid lubricant SL is, for example, one of molybdenum disulfide, tungsten disulfide, graphite, boron nitride, antimony oxide, lead oxide, lead, indium and tin. Also, thermosetting polyamideimide is used as the synthetic resin.

To form the sliding layer 31A, the base member of the swash plate 10 is coated with the fluid synthetic resin containing the solid lubricant SL by well-known technique, such as spray coating, roll coating and screen printing. After drying the coating layer, the sliding layer 31A is completed by baking the coating layer at a temperature between 200° C. and 300° C.

As shown in FIG. 2C, the sliding layer 31B formed on the rear sliding surface 30B is constituted of two layers. In the sliding layer 31B, a first layer 31B-1 is made of a metal layer, which differs from iron series constituting the shoes 20A, 20B. The thickness of the first layer 31B-1, for example, ranges from 60 μm to 70 μm.

The material of the metal constituting the first layer 31B-1, for example, is aluminum alloy containing silicon or intermetallic compound made from aluminum and silicon. Besides, the aluminum alloy and the intermetallic compound are called Al—Si series in the following description. In Al—Si series as aluminum series, the solid-state of the material such as hardness and melting point varies in response to the content of silicon. However, in the material of the Al—Si series used in this embodiment, the content of silicon ranges from 10% to 20% in weight, preferably, from 15% to 18% in weight. The first layer 31B-1 is formed by well-known metal spraying.

In the above-mentioned sliding layer 31B, a second layer 31B-2 is formed on the first layer 31B-1. The second layer 31B-2 as well as the front sliding layer 31A is a synthetic resin layer containing solid lubricant SL, and the thickness of the layer, for example, ranges from 0.5 μm to 10 μm.

As described above, sliding performance with respect to the shoes 20A, 20B improves by forming the layers 31A, 31B on the sliding surfaces 30A, 30B of the swash plate 10. Namely, lubrication between the swash plate 10 and the shoes 20A, 20B is continuously ensured under oilless circumstances by forming the sliding layer 31A, 31B.

According to the present embodiment, the following advantageous effects are obtained.

(1) Relatively high controllable displacement of the compressor and relatively high sliding performance of the swash plate with respect to the shoes 20A, 20B upon operating at high speed are achieved by adopting the above-mentioned swash plate 10 without containing any lead in the base member made of copper series. Particularly, since the base member, which occupies most part of the swash plate 10, does not contain lead, lead contained in the whole swash plate 10 is efficiently reduced, thus contributing to environmental hygienics. Also, even if the sliding layer 31A and/or the second layer 31B-2 of the sliding layer 31B contain lead as solid lubricant, the swash plate 10 as a whole contains a relatively small amount of lead.

(2) In the swash plate 10, the rear sliding surface 30B facing the cylinder block 1 receives different load acting thereon from the front sliding surface 30A opposite to the sliding surface 30B. Namely, a load based on suction reactive force upon pulling the pistons 8 out of the cylinder bores 1 a mainly acts on the front sliding surface 30A to suck refrigerant gas. Meanwhile, a load based on compression reactive force upon pushing the pistons 8 into the cylinder bores 1*a* mainly acts on the rear sliding surface 30B to compress refrigerant gas. The load based on the compression reactive force generally exceeds the load based on the suction reactive force.

Namely, abrasion resistance against the sliding layers 31A, 31B is required of the rear sliding surface 30B.

Accordingly, in the present embodiment, the first layer 31B-1 or a metal layer, which performs relatively high abrasion resistance but requires relatively much cost, is formed only on the rear sliding surface 30B, which is required relatively high abrasion resistance, and only a synthetic resin layer, which requires less cost, is formed on the front sliding surface 30A. Thereby, manufacturing cost of the sliding layers 31A, 31B is reduced, while reliability to slide with the shoes 20A, 20B are maintained at a required level or over.

(3) The first layer 31B-1 of the rear sliding layer 31B is made of Al—Si series containing silicon. Accordingly, solid-state of the first layer 31B-1 such as hardness and melting point is preferable, and abrasion resistance of the first sliding layer 31B-1 further improves.

(4) For example, in the rear sliding layer 31B, since the first layer 31B-1 hardly deforms, it performs relatively high abrasion resistance. However, since the first layer 31B-1 as a metal layer hardly deforms, the first layer 31B-1 possibly cracks when the first layer 31B-1 directly slides with respect to the shoe 20B. Accordingly, the first layer 31B-1 does not directly slide with respect to the shoe 20B by interposing the second layer 31B-2 made of soft synthetic resin. Thereby, the first layer 31B-1 is inhibited from cracking.

The present invention is not limited to the embodiment described above, but may be modified into the following examples.

In the above-described present embodiment, the front sliding layer 31A as well as the rear layer 31B is constituted of two layers, which are a metal layer and a synthetic resin layer containing solid lubricant. In this manner, the sliding performance of the swash plate 10 with respect to the shoes 20A, 20B further improves. Namely, the front sliding layer 31A may be constructed similarly to the rear siding layer 31B.

The sliding layers are constituted of only synthetic resin layers containing solid lubricant. That is, for example, in the present embodiment, the rear sliding layer is constituted of only the synthetic resin layer 31B-2. In this manner, manufacturing cost is further reduced.

The sliding layers are constituted of only metal layers. That is, for example, in the present embodiment, the synthetic resin layers 31A, 31B-2 are removed from the sliding layers 31A, 31B, and the front sliding surface 30A is coated with a metal layer as well as the rear sliding surface 30B.

The sliding layer is constituted of a metal layer formed by plating. For example, the metal layer formed by plating is superior in abrasion resistance to synthetic resin. For example, a material of plating is such as nickel series, cobalt series and copper series, and a method of plating is such as electroplating, chemical plating and electroless plating. In this case, the sliding performance of the swash plate with respect to the shoe further improves by means of composite platings, which disperse solid lubricant in the plating. Furthermore, as a synthetic resin layer containing solid lubricant coats the plating, the plating layer is inhibited from cracking, and the advantageous effect as well as those in the paragraph (3) in the above-described embodiment is obtained.

The base member of the swash plate is made of sintered copper series. In this manner, the surface of the base member is microscopically rough, and the materials of the metal layer or the synthetic resin layer occupy recesses of the microscopically rough surface. Accordingly, the metal layer or the synthetic resin layer firmly adheres to the base member, and the sliding layer may ensure not only high durability but also high sliding performance.

The base member of the swash plate is made of copper series containing bismuth. In this manner, for example, when the sliding layer is abraded, and when the base member of the swash plate directly slides with respect to the shoe, sliding performance between the base member of the swash plate and the shoe is maintained at a necessary level.

The metal layer contains solid lubricant. In this manner, sliding performance of the swash plate with respect to the shoes further improves.

According to the swash plate in the present invention, high controllable displacement of the swash plate type variable displacement compressor and high sliding performance of the swash plate with respect to the shoes upon operating at high speed are achieved without containing any lead in the material of the swash plate.

Therefore, the present examples and embodiments are to be considered as illustrative and not restrictive and the invention is not to be limited to the details given herein but may be modified within the scope of the appended claims.

What is claimed is:

1. A swash plate type variable displacement compressor comprising:

a housing formed by a cylinder block, a front housing, and a rear housing;

a drive shaft rotatably supported by the housing;

a swash plate operatively connected to the drive shaft, the swash plate integrally rotatable with the drive shaft and tiltable relative to the drive shaft;

a piston engaging with the swash plate through a pair of shoes;

wherein rotation of the drive shaft is converted to reciprocation of the piston through the swash plate and the shoes, and the displacement of the compressor is adjusted by varying the inclination angle of the swash plate with respect to a plane perpendicular to the axis of the drive shaft; and wherein the swash plate includes a base member made of copper series and a sliding layer coating a sliding surface of the base member with respect to the shoes.

2. The swash plate type variable displacement compressor according to claim 1, wherein the only sliding surface of the swash plate facing the cylinder block is coated with a metal layer.

3. The swash plate type variable displacement compressor according to claim 2, wherein the metal layer is coated with a synthetic resin layer, and the other sliding surface of the swash plate opposite to the cylinder block is coated with a synthetic resin layer.

4. The swash plate type variable displacement compressor according to claim 1, wherein the thickness of the sliding layer on the sliding surface of the swash plate opposite to the cylinder block ranges from 0.5 $\mu$m to 10 $\mu$m.

5. The swash plate type variable displacement compressor according to claim 1, wherein the sliding layer is either the sliding layer on the surface of the swash plate facing the cylinder block or the sliding layer on the surface of the swash plate opposite to the cylinder block, and the sliding layer is a synthetic resin layer containing solid lubricant.

6. The swash plate type variable displacement compressor according to claim 5, wherein the material of the synthetic resin layer is thermosetting polyamideimide.

7. The swash plate type variable displacement compressor according to claim 1, wherein the sliding layer is either the sliding layer on the surface of the swash plate facing the cylinder block or the sliding layer on the surface of the swash plate opposite to the cylinder block, and the sliding layer is a metal layer formed by metal spraying.

8. The swash plate type variable displacement compressor according to claim 1, wherein the sliding layer is either the sliding layer on the surface of the swash plate facing the cylinder block or the sliding layer on the surface of the swash plate opposite to the cylinder block, and the sliding layer is a metal formed by plating.

9. The swash plate type variable displacement compressor according to claim 8, wherein the metal layer is formed by plating with one of nickel series, cobalt series and copper series.

10. The swash plate type variable displacement compressor according to claim 1, wherein the sliding layer is either the sliding layer on the surface of the swash plate facing the cylinder block or the sliding layer on the surface of the swash plate opposite to the cylinder block, and the sliding layer includes a metal layer and a synthetic resin layer containing solid lubricant.

11. The swash plate type variable displacement compressor according to claim 10, wherein the thickness of the metal layer ranges from 60 $\mu$m to 70 $\mu$m.

12. The swash plate type variable displacement compressor according to claim 10, wherein the thickness of the synthetic resin layer ranges from 0.5 $\mu$m to 10 $\mu$m.

13. The swash plate type variable displacement compressor according to claim 1, wherein the sliding layer is either the sliding layer on the surface of the swash plate facing the cylinder block or the sliding layer on the surface of the swash plate opposite to the cylinder block, and the sliding layer includes a metal layer containing solid lubricant.

14. The swash plate type variable displacement compressor according to claim 13, wherein the solid lubricant is at least one of molybdenum disulfide, tungsten disulfide, graphite, boron nitride, antimony oxide, lead oxide, lead, indium and tin.

15. The swash plate type variable displacement compressor according to claim 1, wherein the material of the base member contains no lead.

16. The swash plate type variable displacement compressor according to claim 1, wherein the material of the base member contains bismuth.

17. The swash plate type variable displacement compressor according to claim 1, wherein the base member is made of solid copper series.

18. The swash plate type variable displacement compressor according to claim 1, wherein the base member is made of sintered copper series.

19. The swash plate type variable displacement compressor according to claim 1, wherein the sliding layer is either the sliding layer on the surface of the swash plate facing the cylinder block or the sliding layer on the surface of the swash plate opposite to the cylinder block, and the sliding layer is a metal layer made of Al—Si series.

20. The swash plate type variable displacement compressor according to claim 19, wherein the content of silicon contained in the material of the metal layer ranges from 10% to 20% in weight.

21. The swash plate type variable displacement compressor according to claim 20, wherein the content of silicon contained in the material of the metal layer ranges from 15% to 18% in weight.

22. The swash plate type variable displacement compressor according to claim 1, wherein one of sliding surfaces of the swash plate which receives a higher load is coated with a metal layer and a synthetic resin layer, and the other of the sliding surfaces of the swash plate which receives a lower load is coated with a synthetic resin layer.

* * * * *